United States Patent [19]

Baron, Jr. et al.

[11] 4,033,922

[45] July 5, 1977

[54] SYNTHETIC SIZES

[75] Inventors: Joseph J. Baron, Jr., Morris Plains; Sherman Krefting, Teaneck, both of N.J.

[73] Assignee: Diamond Shamrock Corporation, Cleveland, Ohio

[22] Filed: Mar. 30, 1976

[21] Appl. No.: 671,967

Related U.S. Application Data

[62] Division of Ser. No. 481,214, June 20, 1974, Pat. No. 3,974,326.

[52] U.S. Cl. ..... 260/29.6 RW; 252/8.6; 526/317

[51] Int. Cl.[2] ..... C08F 220/06

[58] Field of Search ..... 252/8.6; 526/317; 260/29.6 RW

[56] References Cited

UNITED STATES PATENTS

| | | | |
|---|---|---|---|
| 2,244,703 | 6/1941 | Hubbuch | 526/317 |
| 2,244,704 | 6/1941 | Brubaker | 526/317 |
| 3,070,561 | 12/1962 | Hager et al. | 260/29.6 RW |
| 3,635,915 | 1/1972 | Gale | 526/317 |

*Primary Examiner*—John Kight, III
*Attorney, Agent, or Firm*—Neal T. Levin; Leslie G. Nunn

[57] ABSTRACT

Synthetic sizes for use on yarns in water jet looms are prepared by copolymerizing methacrylic acid with from about 3% by weight to about 15% by weight of acrylic acid or vinylethoxytetraethylene glycol as the comonomer. These sizes are useful as nylon warp sizes in water jet looms. They have the desired adhesion to nylon and water resistance plus non-adhesion to steel parts on the loom.

3 Claims, No Drawings

SYNTHETIC SIZES

This is a division of application Ser. No. 481,219, filed June 20, 1974, now U.S. Pat. No. 3,974,321.

BACKGROUND OF THE INVENTION

1. Field of the Invention

This invention relates to synthetic sizes for use on yarns and particularly to yarn warp sizes for use in water jet looms.

2. Description of the Prior Art

Specialized product water jet looms offer many advantages over conventional looms in weaving textiles. Originally designed for synthetic filament weaving in plain, twill and satin constructions, these looms are now being used to produce premium price fabrics. Water jet looms can be operated on a seven day basis at one-third the manpower, power and water cost of conventional looms. Further, these looms provide clean working conditions in that wet processing practically eliminates lint and fly. Every function of water jet looms is electrically controlled by the micro-amperage carried by the wet yarn so that any yarn breaks or misinsertions of filling are detected by probes which stop the loom within one-eighth of a second.

A major problem in the operation of water jet looms is that proper sizing materials are not available. The shed opening on the looms is so small and the electronic controls are so fine, that fuzzy yarns either transfer with the jets or tend to trip the stop motion which will stop the loom within one-eighth of a second. For example, serious shedding problems (lack of adhesion) have been noted with an 85/15 acrylate ester/ammonium acrylate copolymer size. Further, a low molecular weight polyacrylic acid size gave poor flow-out on nylon and exhibited great tackiness when exposed to the 100% humidity. There is a definite need for improved synthetic sizes for use on water jet looms.

STATEMENT OF THE INVENTION

A synthetic size for use on yarns in water jet looms is prepared by copolymerization of from about 97% by weight to about 85% by weight of methacrylic acid with about 3% by weight to about 15% by weight of acrylic acid or vinylethoxytetraethylene glycol as the comonomer. From about 0.5 to about 4% by weight dry basis of the synthetic size is applied to the yarn dry basis. The size is useful as a warp size in water jet looms. It has the desired adhesion to yarns and water resistance plus non-adhesion to steel parts on the loom.

DESCRIPTION OF PREFERRED EMBODIMENT

The present invention provides new and unique sizing agents for fibers. These synthetic sizes form films on fibers which have excellent adhesion and flexibility. These sizes, after providing a hard tough protective film on fibers which are unaffected by the abrasive action of water looms and high humidity (100%), must be easily removed by scouring with dilute solutions of alkaline salts.

We have found that these desirable properties can be achieved by synthesis of copolymers of methacrylic acid with from about 3 to about 15% by weight of a comonomer such as acrylic acid or vinylethoxytetraethylene glycol via aqueous solution polymerization to obtain unique hydrophilic-hydrophobic balances which provide these desirable properties.

More specifically, aqueous solution polymerization of methacrylic acid with either of these comonomers at these concentrations to obtain lower molecular weight linear polymers which are completely soluble in water can be accomplished with a redox catalyst. Useful redox catalysts include persulfate-meta-bisulfite, ferrous iron-hydrogen peroxide and persulfate-thiosulfate systems. Either persulfate or hydrogen peroxide alone can be used. A chain retarder such as potassium hypophosphite may be used to ensure production of low molecular weight polymers. Likewise, hypophosphorous acid or its water soluble salts may be used as chain retarders. Aqueous solutions containing 40% by weight of these copolymers have Brookfield viscosities in the range of 500 to 1500 cps at 25° C. These viscosities indicate that the copolymers have low molecular weights.

In practice, the water soluble copolymers described herein are applied to the fiber as a solution containing from about 8% to about 1 % by weight of the aqueous copolymer, preferably from about 6% to about 3% by weight of the copolymer. For the best results, the solution should be applied to the fiber at a temperature between about 80° F and about 120° F, and the sized fiber dried on dry cans. The dried sized yarn sheet is then separated by split rods into individual size yarns and collected on a beam which is then placed on the loom for weaving. At these temperatures, the solution of size is less viscous and covers the yarn more readily and uniformly. The solution of the size is applied to the yarn in an amount and at a concentration sufficient to deposit a sizing quantity of the copolymer on the yarn, preferably between about 0.5 and about 4% by weight of the copolymer (dry solids weight) based on the dry weight of the fiber. Application of the size to the yarn may be accomplished in various ways. For example, the yarn may be passed through the size solution and beneath the surface of the size solution or by spraying the yarn with the size solution and thereafter passing the yarn between squeeze rolls to remove excess solution and to deposit the desired amount of the copolymer on the yarn. The size solution may also be applied in other ways such as by dipping a fiber into the solution of the copolymer. If squeeze rolls are used, the amount of pressure exerted on the squeeze rolls should be adjusted to remove sufficient excess size solution to deposit the desired amount of copolymer on the yarn.

The size solution may also contain other sizing adjuvants such as urea, humectants, oils, wetting agents, and the like. As examples of humectants may be mentioned glycerine, ethylene glycol, sorbitol, propylene glycol, polyethylene glycols, polyglycerols, polypropylene oxides, and the like. Oils which may be used include the sulfonated animal, mineral and vegetable oils or mixtures thereof, water-emulsifiable mixtures of such oils with animal oils, mineral oils, vegetable oils, Twitchell oil, and the like. As examples of wetting agents may be mentioned acid-stable anionic wetting agents such as alkyl substituted benzene sodium sulfonates, in which the alkyl group contains from about 10 to 20 carbon atoms, alkali metal or ammonium monoalkyl sulfosuccinates, in which the alkyl group contains from about 10 to 20 carbon atoms, and the like; and acid-stable non-ionic wetting agents such as the surface active condensation products of ethylene oxide with an alkylated phenol having from 8 to 20 carbon atoms in the alkyl group or an alkyl mercaptan having from 8 to 20 carbon atoms.

The copolymers of this invention are effective in water or aqueous solutions as sizes for a variety of natural and synthetic textile fibers. Examples of such fibers include those made from nylon, polyesters such as poly(ethylene terephthalate) and poly(1,4-cyclohexylene dimethylene terephthalate), cotton, rayon, cellulose acetate, and polypropylene. Therefore, although one use of the copolymers of the invention will be illustrated by references to nylon, they may be used on other types of textile materials.

For a fuller understanding of the nature and objects of this invention, reference may be made to the following examples which are given merely to illustrate the invention and are not to be construed in a limiting sense. All weights, proportions, and percentages are on a weight basis unless otherwise indicated. All temperatures are ° C unless otherwise indicated.

EXAMPLE I

Preparation of a synthetic size solution containing a copolymer of methacrylic acid and acrylic acid.

A total of 9.001 parts by weight of methacrylic acid, 0.999 parts by weight of acrylic acid and 0.020 parts by weight of potassium hypophosphite were dissolved in 14.977 parts by weight of deionized water by stirring at room temperature while purging with nitrogen. The solution of monomers was heated to 60° C to 65° C over 0.5 hour. Then there was added 0.001 parts by weight of sodium metabisulfite and 0.001 parts by weight of potassium persulfate to the solution of monomers. An exothermic reaction occurred. The reaction mixture was reacted at 70° to 80° C for 0.5 to 2 hours or until a Brookfield viscosity of 1000–1500 cps at 25° C was obtained with a No. 2 spindle at 12 rpm (without guard). After a satisfactory viscosity was obtained, 0.0015 parts by weight of hydroquinone was added. The mixture agitated for 0.5 hour and then cooled to 25° C to 30° C to obtain an aqueous copolymer solution.

Two parts by weight of n-propanol was added to 25 parts by weight of the copolymer solution and the solution agitated until homogeneous. Then 73.00 parts by weight of water was added to obtain an aqueous copolymer solution containing 10% by weight (solids) of the copolymer of 90 parts by weight methacrylic acid and 10 parts by weight of acrylic acid. Evaluation of this copolymer solution as a synthetic size is described in Example III.

EXAMPLE II

Preparation of a synthetic size solution containing a copolymer of methacrylic acid and vinylethoxytetraethylene glycol.

A total of 21.22 parts by weight of methacrylic acid, 3.75 parts by weight of vinylethoxytetraethylene glycol and 0.13 parts by weight of potassium hypophosphite were dissolved in 74.09 parts by weight of deionized water with stirring at room temperature. The solution of monomers was heated to 65° to 70° C over 0.5 hour, while purging with nitrogen. Then 0.00065 parts by weight of potassium persulfate was added as a 0.1% by weight solution to the mixture of monomers. The mixture was reacted for 1 hour at 65° C to 70° C and 0.00065 parts by weight of potassium persulfate added as a 0.1% by weight solution to the monomer mixture and heated for an additional 2 hours at 65° C to 70° C. Viscosity of a cooled sample at 25° C was checked and the polymerization was continued until a cooled sample of the mixture had a Brookfield viscosity of 500–1,000 cps with a No. 2 spindle at 30 rpm at 25° C. Then 0.001 parts by weight of hydroquinone was added to the copolymer solution. The solution was then stirred for 0.5 hour at 65° C and cooled to room temperature.

Two parts by weight of n-propanol was dissolved in 40 parts by weight of the copolymer solution obtained above by stirring the mixture at room temperature. Then 58.0 parts by weight of deionized water was added at 25° C while slowly stirring the mixture. The resulting aqueous copolymer solution contained 10% by weight (solids) of the copolymer of 85 parts by weight of methacrylic acid and 15 parts by weight of vinylethoxytetraethylene glycol. Evaluation of this solution as a synthetic size is described in Example III.

EXAMPLE III

The synthetic sizes prepared in Example I and Example II were evaluated for adhesion on nylon using the following procedure. A 10% by weight aqueous solution of each synthetic size was applied onto nylon 66 film, drawn as a wet film on the nylon with a 3 mil bar and cured by drying for 1 minute at 240° F. Adhesion of the cured drawn size film to the nylon was tested using a cross-hatch type of tape (3M-610 tape). This test is a modification of ASTM Test D-3002-71. It provides a qualitative indication of adhesion of the size to nylon. Samples prepared with the synthetic sizes described in Example I and Example II above exhibited good adhesion to nylon in this test.

The samples of synthetic sizes on nylon were then stored in a desiccator at 100% relative humidity and room temperature for 24 hours. Samples prepared with the synthetic sizes from Example I and Example II were non-tacky after exposure to 100% relative humidity for 24 hours.

The samples were then immersed in water at room temperature for 1 to 2 hours and their general appearance noted. The size films were unchanged, that is, they did not swell and were not removed by immersion in water under these conditions. It was necessary to immerse these samples in aqueous solutions containing 2 to 3% by weight of tetrasodium pyrophosphate, sodium metasilicate or a sodium salt of a sulfated ethyoxylated alcohol at room temperature to remove the size from the nylon film.

Adhesion of the synthetic sizes prepared in Example I and Example II above was also evaluated on steel using the following procedure. A wet film of the size was drawn with a 3 mil bar onto a steel plate and cured by drying for 1 minute at 240° F. The synthetic sizes did not adhere to the steel.

While the invention has been described with reference to certain specific embodiments thereof, it is understood that it is not to be so limited since alterations and changes may be made therein which are within the full and intended scope of the appended claims.

What is claimed is:

1. A synthetic size for use on yarn in a water jet loom comprising an aqueous solution of a copolymer comprising from about 97% to about 85% by weight of methacrylic acid and from about 3% to about 15% by weight of a comonomer selected from the group consisting of acrylic acid and vinylethoxytetraethylene glycol.

2. The synthetic size of claim 1 wherein about 90% by weight of methacrylic acid and about 10% by weight of acrylic acid are present in the copolymer in the size.

3. The synthetic size of claim 1 wherein about 85% by weight of methacrylic acid and about 15% by weight of vinylethoxytetraethylene glycol are present in the copolymer in the size.

* * * * *